United States Patent [19]

Dawless et al.

[11] 4,411,747

[45] Oct. 25, 1983

[54] PROCESS OF ELECTROLYSIS AND FRACTIONAL CRYSTALLIZATION FOR ALUMINUM PURIFICATION

[75] Inventors: Robert K. Dawless, Monroeville; Kenneth A. Bowman, Leechburg; Robert M. Mazgaj, Lower Burrell; C. Norman Cochran, Oakmont, all of Pa.

[73] Assignee: Aluminum Company of America, Pittsburgh, Pa.

[21] Appl. No.: 412,833

[22] Filed: Aug. 30, 1982

[51] Int. Cl.[3] ..... C25C 3/06; C22B 21/02

[52] U.S. Cl. ..... 204/67; 75/68 R

[58] Field of Search ..... 204/67, 245; 75/68 R; 23/305 A

[56] References Cited

U.S. PATENT DOCUMENTS

| | | | |
|---|---|---|---|
| 2,539,743 | 1/1951 | Johnson | 204/67 |
| 4,115,215 | 9/1978 | Das et al. | 204/67 |
| 4,221,590 | 9/1980 | Dawless et al. | 75/68 R |

FOREIGN PATENT DOCUMENTS 49600 4/1982 European Pat. Off. .

*Primary Examiner*—G. L. Kaplan
*Assistant Examiner*—Nam X. Nguyen
*Attorney, Agent, or Firm*—Elroy Strickland

[57] ABSTRACT

A method for purifying aluminum that contains impurities, the method including the step of introducing such aluminum containing impurities to a charging and melting chamber located in an electrolytic cell of the type having a porous diaphragm permeable by the electrolyte of the cell and impermeable to molten aluminum. The method includes further the steps of supplying impure aluminum from the chamber to the anode area of the cell and electrolytically transferring aluminum from the anode area to the cathode through the diaphragm while leaving impurities in the anode area, thereby purifying the aluminum introduced into the chamber. The method includes the further steps of collecting the purified aluminum at the cathode, and lowering the level of impurities concentrated in the anode area by subjecting molten aluminum and impurities in said chamber to a fractional crystallization treatment wherein eutectic-type impurities crystallize and precipitate out of the aluminum. The eutectic impurities that have crystallized are physically removed from the chamber. The aluminum in the chamber is now suited for further purification as provided in the above step of electrolytically transferring aluminum through the diaphragm.

10 Claims, 2 Drawing Figures

PROCESS OF ELECTROLYSIS AND FRACTIONAL CRYSTALLIZATION FOR ALUMINUM PURIFICATION

The Government has rights in the subject invention pursuant to Contract No. DEAC-01-77CS40079 awarded by the Department of Energy.

BACKGROUND OF THE INVENTION

The present invention relates generally to purification of metal, and particularly to a process and apparatus in which the purification is effected by both a fractional crystallization and an electrolytic process.

Of the known methods of purifying aluminum, two are fractional crystallization involving the crystallization of eutectic impurities in molten aluminum and the electrolytic separation of aluminum and impurities by use of a diaphragm that is permeable by a molten salt electrolyte, into which are dissolved ions containing one or more aluminum atoms, but which restricts the passage of molten aluminum and constituents such as iron and silicon. Art showing the use of fractional crystallization as a means to purify aluminum includes U.S. Pat. Nos. 3,211,547 to Jarrett et al., 3,303,019 to Jacobs and 4,221,590 to Dawless et al. Patents showing the use of a permeable diaphragm in an electrolytic cell to purify aluminum include U.S. Pat. Nos. Re. 30,330 to Das et al. and 4,214,955 and 4,214,956 to Bowman. The disclosures of these patents are incorporated here by reference.

Figure 1:
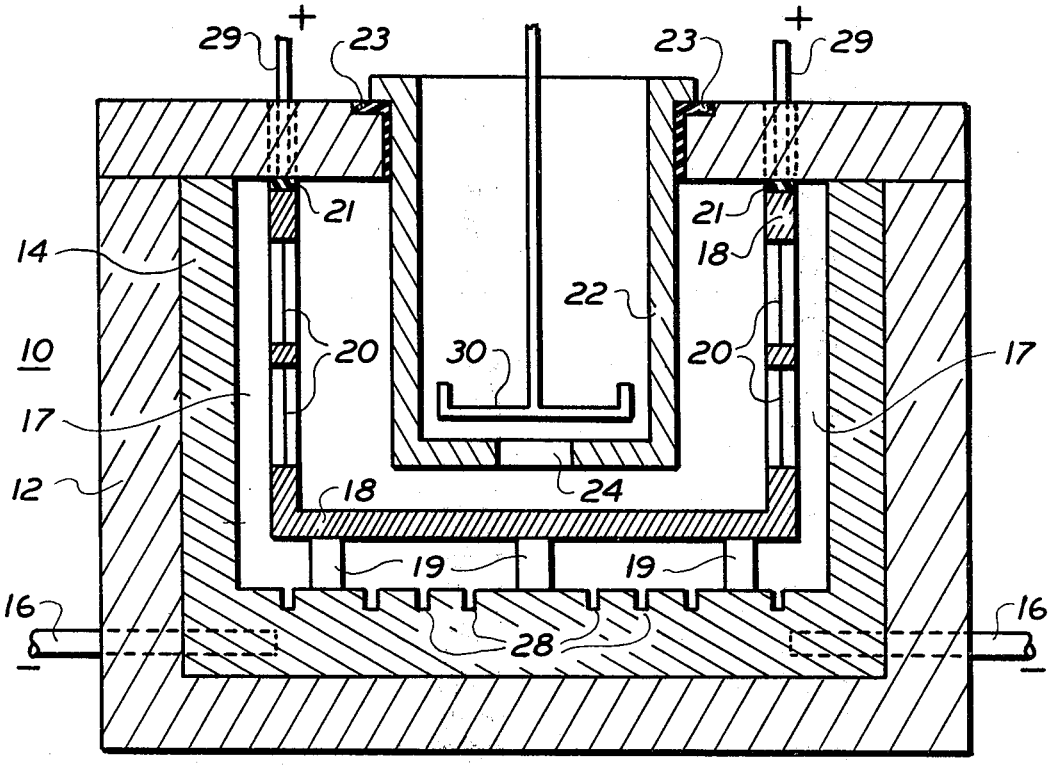

Patent application Ser. No. 369,610 to Helling et al. shows the combination of a main melting cell and two forehearths for purifying aluminum. The forehearths are used for removing "segregation grains" and for receiving fresh anode alloy and aluminum to be refined. The forehearths are joined to the main cell by sloping channels, as seen in FIG. 1 of the publication.

In FIG. 7 of U.S. Pat. No. 2,539,743 to Johnson, an initial hearth 85 is used to selectively melt aluminum and not copper and iron impurities in the aluminum. The melted aluminum is then directed to a cell 82 having electrolytic diaphragms where the aluminum is further purified. Two separate vessels are used and the vessels are connected together by channel means, as in the Helling et al. publication.

Yet another reference showing the purification of aluminum is U.S. Pat. No. 4,222,830 to Dawless et al. The disclosure of this patent is directed to the use of an electrolytic cell to first effect purification of an aluminum charge, and then to further purify the aluminum by use of a fractional crystallization cell that is separate from the electrolytic cell. The aluminum that contains high levels of impurities obtained in the latter cell can then be returned to the electrolytic cell and be mixed with primary aluminum in that cell and hence provide savings in the inventory of impure or primary aluminum required to produce high purity aluminum.

BRIEF SUMMARY OF THE INVENTION

The present invention involves the use of a container or chamber located in an electrolytic cell having a box-like structure provided with a permeable diaphragm, the chamber being disposed to receive (be charged with) scrap aluminum that contains impurities. The chamber in addition, is a part of an anode area of the cell, with the diaphragm being located between a cathode of the cell and the chamber. Molten impure aluminum is provided to the anode compartment of the cell. This can either be added in the molten state or charged to the chamber as a solid and then subsequently melted. With an appropriate potential difference established between the cathode and anode area of the cell, and an appropriate current density, the aluminum forms ionic ($AlCl_4^{-1}+Al_2Cl_7^{-1}$) species in the electrolyte on the anode side of the diaphragm, which species is carried by diffusion and convection through the diaphragm and the electrolyte to the cathode where it is reduced to form the purified aluminum product. Surface tension along the porous diaphragm keeps the unpurified molten aluminum per se on the anode side of the membrane.

The aluminum in the anode area of the cell is depleted because of the ionic transfer thereof through the diaphragm. This results in a concentration of impurities in the metal remaining in the anode compartment. This metal is at a temperature that is higher than the aluminum and impurities in chamber 22, as at least the upper portion of the chamber is somewhat remote from the heat produced in the cell by $I^2R$ losses in the electrolyte. Because of the lower temperature in the chamber, which can be controlled by appropriate means discussed hereinafter, eutectic-type impurities crystallize and precipitate out of the aluminum. This creates a purer melt in the chamber than that in the area of the diaphragm such that a concentration gradient of impurities is formed between the two. The impurities in the vicinity of the diaphragm now diffuse into the melt in the chamber, through the opening 24 in the bottom thereof, as the melts of the two areas (volumes) seek equilibrium. After such precipitated impurities reach a certain percentage of the molten metal in the chamber, the precipitated impurities are removed from the chamber.

Solid material, such as aluminum scrap, can be fed directly into the chamber of the invention, as the chamber keeps such solids from contacting and cutting the porous diaphragms. In addition, two chambers may be used, i.e., one chamber for receiving the charge of metal to be purified, and one chamber for the fractional crystallization process.

The process of the invention can be run (1) continuously, (2) in a batch mode, or (3) in a hybrid mode. The hybrid mode involves a continuous electrolysis process and a batch or semicontinuous mode for the fractional crystallization portion of the invention.

THE DRAWINGS

Figure 2:
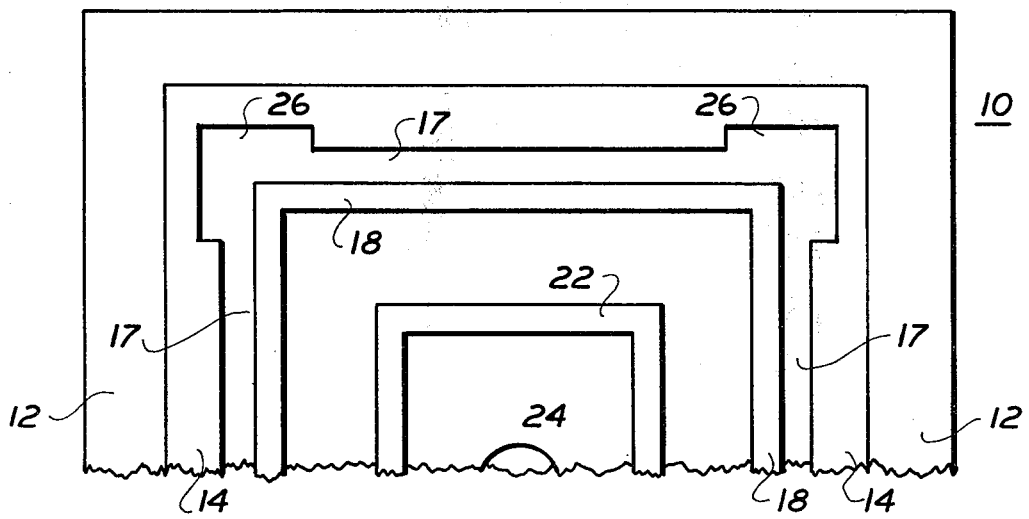

The invention, along with its objectives and advantages, will be best understood from consideration of the following detailed description and the accompanying drawings, in which:

FIG. 1 depicts in vertical section the cell and crystallization chamber of the invention, while FIG. 2 shows a partial plan view of the cell and chamber.

PREFERRED EMBODIMENT

Referring now to FIG. 1 of the drawings, an electrolytic cell and crystallization structure 10 are shown in which an outer wall structure 12 contains and supports a cathode 14 of the electrolytic cell. Conductor bars 16 extend through the lower wall of the structure and into the bottom portion of the cathode for applying a negative electrical potential to the cathode.

In addition, between outer wall 12 and cathode 14 can be located insulating refractory material (not shown) to prevent or at least substantially reduce heat loss from the cell.

Within the cell interior borderd by cathode 14 is disposed a box-like structure 18, 18 being located in close proximity (0.56 to 2.14 cm) to the cathode to define a suitable anode-to-cathode (AC) interelectrode space 17 and distance for efficient operation of the cell. (In FIG. 1 space 17 is depicted as rather large for purposes of illustration.)

In the invention, 18 can be electrically conductive or nonconductive. If 18 is conductive, it is insulated from the top wall of the cell at 21, and is made of a suitably conductive material, such as graphite. If 18 is nonconductive, shorting (as discussed hereinafter) between the metal collected on the cathode and the diaphragm will not or will be at least less likely to take place. Because of this, a smaller anode-to-cathode distance can be employed which increases the current efficiency of the cell and reduces the amount of electrolyte needed in the cell. In fact, the AC distance may be reduced to that of the thickness of the diaphragm.

The material of 18 must be heat resistant and inert to the bath or electrolyte (not shown) of the cell and to the aluminum (not shown) to be purified.

In FIG. 1 box 18 is shown supported on cathode 14 by posts 19 made of an inert, insulating and heat resistant material, such as silicon oxynitride.

As depicted in FIG. 1 box-like structure 18 is provided with windows 20 made of a permeable diaphragm material such as reticulated vitreous carbon (RVC) or a cloth fabricated from fibers of carbon or graphite. Such cloths are commercially available. Fiber Materials, Inc. of Biddeford, Maine is one manufacturer of graphite cloth. A suitable, and commercially available, nonconductive cloth for the diaphragm windows is boron nitride, though other materials are available and suitable. What is required of the material of the cloth is that it (again) remains inert in the environment of the purification process of the invention.

The diaphragm cloth can be attached to the structure of 18 in or over window openings in 18 in a variety of ways. In an experimental cell employing the principles of the invention, the diaphragm material was cemented to 18 using a heat resistant, cement made by Union Carbide. (Union Carbide's name for the cement is C-38 Carbon Cement.) In addition, half round graphite rods may be screwed and cemented into grooves provided in the wall of 18 over the edges of the cloth to provide additional support.

The above experimental box 18 using windows 20 was used for testing the invention because the carbon and graphite cloths were the only materials available. A preferable structure for 18 would be a self-supporting diaphragm material, in which case the whole or at least substantially the whole of box 18 would be available for metal production. This would provide a cell having a productivity greater than the windowed structure of FIG. 1.

Within the box-like structure of 18 is located a chamber 22 for receiving scrap aluminum. For this purpose the upper end of the chamber is shown open, though the upper end can be closed by a suitable lid (not shown). Preferably, the material of the wall of the chamber is a high density graphite and is electrically insulated at 23 from the wall of cell 10 so that the chamber can be electrically connected to the positive side of a direct current power supply (not shown) when the process of the invention is practiced.

The shape of chamber 22 is preferably rectangular, like that of the membrane box 18 and cathode 14. Such a configuration facilitates fabrication of the diaphragm and chamber structures, and control of the AC distance 17 between the anode box and the cathode. (Inert, nonconductive spacers can also be used to maintain proper distance between the diaphragm and cathode.) In addition, a square or rectangular shape provides a reasonable ratio of working surface to volume of molten metal. Other geometries which provide a larger surface to volume ratio are contemplated and held to be within the spirit of the invention.

The bottom wall of chamber 22 is provided with opening 24, the purpose of which is discussed hereinafter.

As seen in the plan view of FIG. 2 of the drawings, the corners of the cathode structure 14 are enlarged to provide "downcomer" passages and reservoirs 26 for the electrolytic bath. Such passages and reservoirs, in turn, provide paths for either natural convection movement of the bath or the insertion of mechanical stirring devices and hence increased circulation of the bath to remove any concentration gradient of aluminum ions that might exist in the electrolyte in the vicinity of the anode and cathode areas. If the aluminum ionic species are permitted to concentrate in the electrolyte in the vicinity of the anode surface, and if they are permitted to become depleted in the electrolyte in the vicinity of the cathode surface, the voltage increases between the anode area and cathode, as the cell operates under fixed current conditions, i.e., an additional amount of energy is required to transfer the aluminum from the anode to the cathode such that the system reacts by an increase in voltage. This results in greater energy consumption and thus the cost of running the cell. Mechanical stirrers can, in addition, be used to provide downward circulation of the electrolyte in AC space 17 to assist downward movement of purified metal collected on the cathode.

Since FIG. 2 is a partial view of cell 10, only two corners and passages 26 are visible. However, all four corners of the structure may be provided with the downcomer passages.

The electrolyte in enlarged passages 26 is also cooler than the electrolyte within the interelectrode space 17 in close proximity to the diaphragm. As passages 26 are somewhat remote from the diaphragm, and as the enlarged gap substantially reduces current flow thereacross, the heat generating $I^2R$ losses are minimal. Hence, 26 can function to precipitate and collect extraneous materials present in the bath. This results in better coalescence of the aluminum, as the presence of oxides tends to prevent or limit coalescence.

To prevent or at least substantially reduce any tendency of shorting between the cathode and the anode area of the electrolytic cell of structure 10, the distance between the cathode 14 and membrane box 18 can be tapered, i.e. the distance between the two can be relatively large near the bottom of the cell and decreases to a smaller distance in approaching the upper portion of the cell. In this manner, as droplets of metal form on the cathode and start to descend toward the cell bottom under force of gravity, any accumulation of the droplets in descending will have an increasing volume in which to accumulate.

The operation of the invention is as follows. A molten salt electrolyte of aluminum chloride dissolved in one or more halides of higher decomposition potential than the aluminum chloride is provided in the cell of 10 and heated to a temperature of about 800° C. A suitable bath composition may comprise (in percent by weight) 53% NaCl, 40% LiCl, 0.5% $MgCl_2$, 0.5% KCl, 1% $CaCl_2$ and 5% $AlCl_3$ though the invention is not limited to such a composition.

The electrolyte can be heated by the use of resistance heaters (not shown) located in the cell or by gas heaters. Or, the electrolyte can be heated in a separate vessel and then poured into the cell of 10 in a molten state.

The hot electrolyte heats chamber 22, which chamber is now surrounded by the bath of the electrolyte. If the chamber is empty, the bath also enters into the chamber through the bottom opening 24 thereof, the material of the chamber wall, though, being impervious to the bath. When scrap metal is fed to the chamber, the electrolytic bath rises therein.

Molten or solid scrap metal can be disposed in chamber 22 for purification. If the scrap is solid, it melts rapidly in the chamber and enters through opening 24 into the volume between 22 and 18. It thereby displaces the electrolytic bath from diaphragm box 18 and into space 17 since, as earlier described, the diaphragm is permeable to the electrolyte.

Preferably, a potential difference of 1.5 to 2 volts is provided between cathode 14 and diaphragm box 18, as such a potential difference provides a current density in the electrolyte that is highly efficient in the production of metal while simultaneously avoiding destructive electrolysis of the electrolyte, i.e., avoiding the generation of $Cl_2$ at the anode of the cell. A negative potential is provided on the cathode via bars 16 from a suitable direct current power supply, and a positive potential can be applied to the diaphragm box 18, as indicated schematically in FIG. 1 by conductors 29. The corners of box 18, for example, can be provided with thick wall portions to receive conductors 29. Or, the ends of conductors 29 can be simply disposed in the molten metal contained in box 18.

The metal in diaphragm box 18, with the appropriate positive potential applied thereto, acts as the anode of the cell, with current flowing from the anode to cathode 14 through the composition of the electrolyte. In the process, electrolysis of the aluminum takes place, which electrolysis forms an ionic species of aluminum, i.e., the aluminum species loses three electrons ($Al+4Cl^- \rightarrow AlCl_4^- + 3e^-$) to the metal in the anode area, and passes dissolved in the electrolyte through the diaphragm windows 20 while the surface tension of the molten aluminum and impurities keep the same on the anode side of the windows. At the cathode, the species gains three new electrons to become (again) an elemental species of pure aluminum metal. The elemental aluminum collects on the cathode and settles from the side walls of the cathode to the horizontal cathode surface at the bottom of the cell.

As the electrolytic process occurs, the amount of aluminum relative to the impurities in the anode area decreases. However, the temperature of such impure aluminum in the space between 22 and 18 is such that the impurities will not precipitate out of solution. However, in chamber 22, the metal and impurities therein are cooler than the contents in diaphragm box 18, as the upper end of the chamber extends in the cooler, upper wall of the cell. This causes crystallization of eutectic impurities in the chamber such that the impurities precipitate out of the metal in the chamber. The metal in the chamber is now purer than the metal in the area of the diaphragm, the impurities having been concentrated therein by the electrolytic process. A composition gradient now exists between the two areas and volumes, which gradient causes migration and diffusion of the impurities from the diaphragm to the chamber as the solution seeks an equilibrium condition.

The crystals can be removed from chamber 22 in a variety of ways. Certain of the impurities, such as silicon crystals, will tend to rise to the upper level of the melt in the chamber (depending upon the alloy of the melt), and can thus be removed by scraping the same from the melt. In the case where the crystals tend not to rise in the melt, a false bottom 30 in chamber 22 can be employed to collect impurities at the bottom of the chamber, and then be raised to the top thereof for removal therefrom. Such a concept is disclosed in U.S. Pat. No. 4,312,847 to Dawless, the disclosure of which is incorporated here by reference.

Other means, however, can be employed to remove crystals from chamber 22. These include means for removing the chamber from the electrolytic cell and rotating the chamber so that crystals are poured from the chamber. Another known (U.S. Pat. No. 3,543,531 to Adams) method of removing crystals from a molten bath involves a "cold finger" structure that is inserted vertically into the bath. The structure has threaded grooves on the outside surface thereof as an auger such that the crystals freeze in the grooves, and are removed by rotating the structure about its axis. The threaded grooves bring the crystals to the top of chamber 22 where they are removed from the finger structure. Yet another method of separating crystals from the melt in chamber 22 is by use of a rotating vessel in which centrifugal force is employed as the separating mechanism. Such means is disclosed in U.S. Pat. Nos. 3,801,003 and 3,846,123 to Racunas et al.

The aluminum and impurities remaining in chamber 22 after the eutectic crystals are removed return to graphite box 18 through opening 24 in the container. In 18, the aluminum is again subjected to the electrolytic process of the invention to effect further purification of the aluminum.

Advantages of the combination of the invention lie in the availability of a single unit structure to provide an aluminum product of maximum purity, the single unit being compact and therefore requiring minimal floor space. In addition, two purification processes take place simultaneously and continuously, i.e., while eutectic impurities are being removed from chamber 22, the electrolytic purification process in the anode-cathode space 17 continues to separate pure aluminum from the metal in the diaphragm box. Further advantages lie in the fact that enegy is conserved, as heat loss is kept to a single structure rather than two structures, and there are decreased metal losses, as the aluminum is not subject to air oxidation that would occur during a process that would require transportation and remelting of the aluminum.

While the invention has been described in terms of preferred embodiments, the claims appended hereto are intended to encompass other embodiments which fall within the spirit of the invention.

What is claimed is:

1. An improved process for purifying aluminum containing impurities, comprising:

(a) introducing aluminum that contains impurities to a charging chamber associated with an electrolytic cell of the type having a porous diaphragm located in and permeable by the electrolyte of the cell, and impermeable to aluminum;

(b) supplying impure aluminum from the chamber to an anode area of the cell;

(c) electrolytically transferring aluminum from the anode area to the cathode of the cell through said diaphragm while leaving impurities in the anode area, thereby purifying the aluminum introduced into the container;

(d) collecting purified aluminum at the cathode;

(e) lowering the level of eutectic impurities concentrated in the anode area due to said electrolytic transfer by subjecting molten aluminum and impurities in said chamber to a fractional crystallization treatment to concentrate eutectic impurities thereby providing separation of such impurities from aluminum, the aluminum being suited for further purification, as provided in step (c); and (f) removing the eutectic impurities from the chamber.

2. The process of claim 1 including the step of directing the electrolyte through vertically extending reservoir areas provided in the corners of the cell.

3. The process of claim 1 in which the heat of the electrolytic cell is effective to melt a charge of solid metal directed to the melting chamber.

4. The process of claim 1 in which two chambers are disposed in the electrolytic cell, one chamber being disposed to receive feed metal, and the other chamber being disposed to receive molten metal from the cell for the fractional crystallization process.

5. The process of claim 1 in which the electrolyte of the cell comprises, in percent by weight, about 53% NaCl, 40% LiCl, 0.5% $MgCl_2$, 0.5% KCl, 1% $CaCl_2$ and 5% $AlCl_3$.

6. The process of claim 1 in which an electrically conductive material is used for the porous diaphragm.

7. The process of claim 1 in which an electrically nonconductive material is used for the porous diaphragm.

8. The process of claim 1 in which the space between the cathode and diaphragm is tapered such that the distance between them is larger adjacent the bottom than the distance adjacent the top of the cell.

9. The process of claim 1 in which a false bottom is employed in the melting chamber to remove crystals of eutectic impurities from the chamber.

10. The process of claim 1 in which the melting chamber is removed from the cell and crystals of eutectic impurities are poured from the chamber.

* * * * *